United States Patent [19]

Emerson et al.

[11] 4,351,582

[45] Sep. 28, 1982

[54] ADAPTING ELECTRICAL CONNECTOR

[75] Inventors: James A. Emerson, Pekin; James M. Ramsey, Floyd Knobs; Kerry O. Buck, New Albany, all of Ind.

[73] Assignee: Robinson Nugent, Inc., New Albany, Ind.

[21] Appl. No.: 152,670

[22] Filed: May 23, 1980

[51] Int. Cl.[3] ..... H01R 4/24

[52] U.S. Cl. ..... 339/97 R; 339/97 P

[58] Field of Search ..... 339/97–99, 339/17 F, 176 MF

[56] References Cited

U.S. PATENT DOCUMENTS

| | | | |
|---|---|---|---|
| 4,009,922 | 3/1977 | Aysta | 339/99 R |
| 4,160,574 | 7/1979 | DeRoss | 339/99 R |
| 4,190,952 | 3/1980 | Thomas et al. | 339/99 R X |

FOREIGN PATENT DOCUMENTS

| | | | |
|---|---|---|---|
| 2033676 | 5/1980 | United Kingdom | 339/99 R |

*Primary Examiner*—Eugene F. Desmond

*Attorney, Agent, or Firm*—Woodard, Weikart, Emhardt & Naughton

[57] ABSTRACT

A device is disclosed for making an electrical connection of the contacts of a D-type connector with the conductors of a multi-conductor flat cable assembly, where the pitch of the conductors in the cable assembly is different from that in the D-type connector, and the pitch ratio is not an integer. Contacts employed in the assembly have a portion intermediate conductor contacting end portions and which enables altering the relationship between the end portions in three directions to accommodate the difference in pitch between the conductors connected to one set of contact ends, and the conductors connected to the other set of contact ends, and yet provide the same degree of depth or penetration of contact ends for all of them.

3 Claims, 14 Drawing Figures

ADAPTING ELECTRICAL CONNECTOR

BACKGROUND OF THE INVENTION

1. Field of the Invention

This invention relates generally to electrical connectors, and more particularly to connector devices capable of making electrical connections between two sets of electrical conductors wherein the one set of conductors has a spacing between the conductors thereof which is different from that between the conductors of the other set.

2. Description of the Prior Art

A type of electrical connector which has acquired considerable popularity is the D-type connector. These connectors may typically include a plug or pin portion and a socket portion. The pin and socket contacts are typically arranged in two rows, with the pins having a uniform center-to-center spacing in each of the two rows, and the pins of the one row staggered with reference to the pins of the other row.

A type of wiring device which is in widespread use is a flat cable conductor. It is typically provided with a plurality of round wire conductors in parallel equally-spaced relationship and embedded in some flexible insulator strip. The spacing center-to-center between the conductors of the flat cable is typically different from the spacing between the conductor pins of the D-type connector.

The center-to-center spacing of electrical conductors is sometimes referred to as the pitch of the conductors.

Electrical connectors for making a conductive connection between sets of multiple conductors of different pitches are disclosed in U.S. Pat. No. 3,777,299 and U.S. Pat. No. 3,990,767. The type of connector shown in the latter patent has been employed in connection of flat cable to a D-type connector device.

As may be noted in FIG. 6 of the latter above mentioned patent, the structure disclosed in that patent results in different depths of the contact portions thereof in their respective apertures in the connector housing. We believe it desirable to have a uniform depth of contact exposure in a plug or socket. The present invention is directed to that objective, and yields other advantages as well.

SUMMARY OF THE INVENTION

Described briefly, according to a typical embodiment of the present invention, an electrical contact is provided having sturdy opposite end portions adapted to connection to electrical conductors. An intermediate portion is provided between the end portions. The intermediate portion shape is such as to accommodate relative movement between the end portions in three directions. Yet this intermediate portion is sturdy enough for machine manufacture of the contact in one homogeneous piece of material, and subsequent handling in assembly machines without unintentional plastic deformation of any portion of the contact. These contacts are arrayed in an assembly where the opposite end portions are spaced at different pitches so as to accommodate and provide for the electrical connection between conductors of two different sets, one set of conductors having a pitch different from the pitch of the conductors of the other set. The contacts and their mounting in the connector assembly are such as to provide uniform depth of contact with respect to connector body faces.

BRIEF DESCRIPTION OF THE DRAWINGS

Referring now to the drawings.

DESCRIPTION OF THE PREFERRED EMBODIMENT

Figure 1:
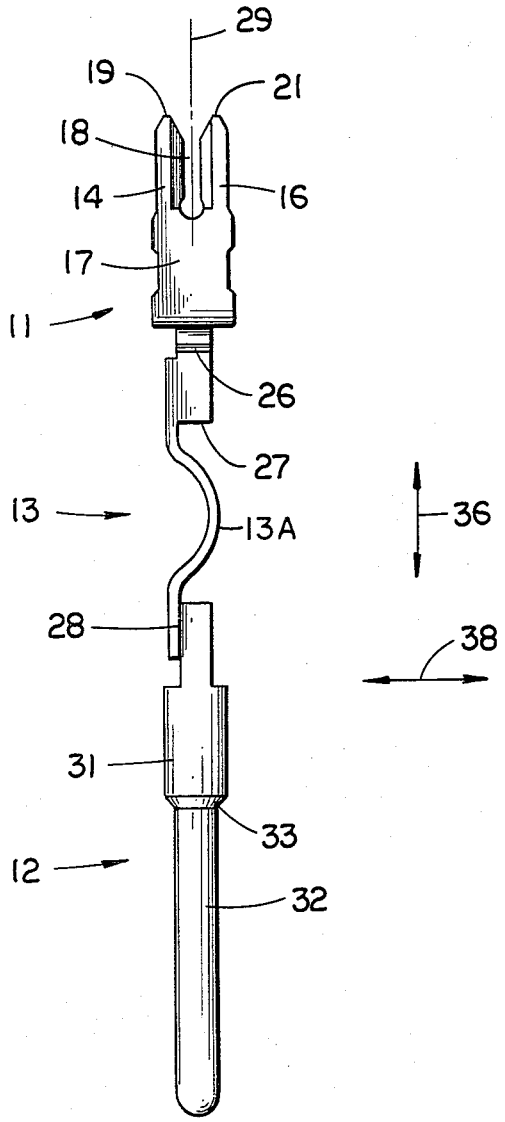
FIG. 1 is a front elevational view showing a contact made according to a typical embodiment of the present invention.
Figure 2:
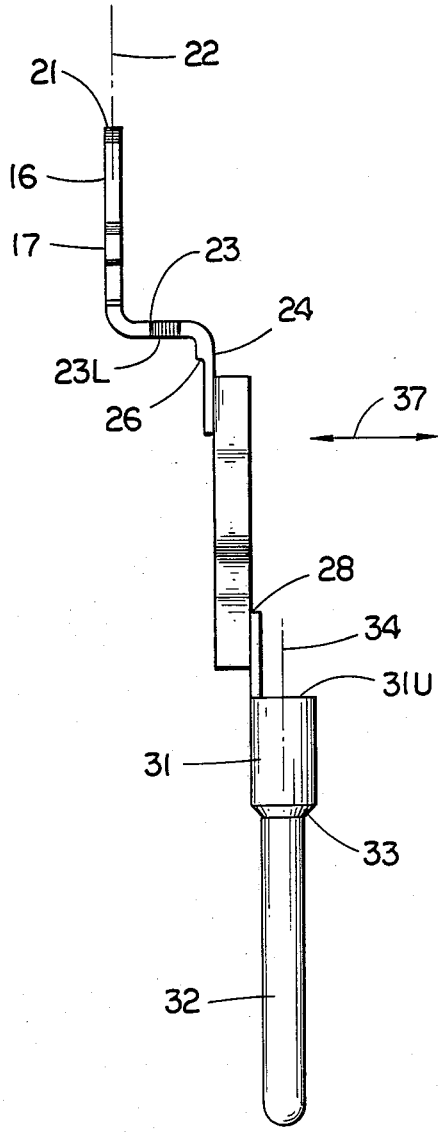
FIG. 2 is a side view thereof.
Figure 3:
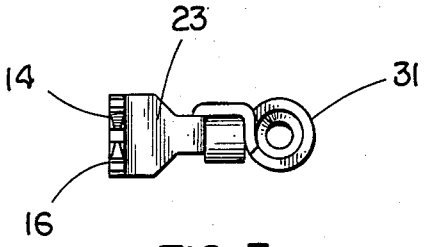
FIG. 3 is a top view thereof.

Referring now to the drawings in detail, and particularly FIGS. 1, 2 and 3, there is shown a contact having upper and lower end portions 11 and 12, and an intermediate portion 13. In the illustrated embodiment, the upper end portion is adapted to an insulation piercing and displacement function for connection to an insulated electrical conductor such as in a flat multi-conductor cable. For this purpose, a yoke is provided, having a pair of prongs 14 and 16 which project upwardly from a bight portion 17, forming a conductor wire receiver slot 18 between the prongs. The upper ends of the prongs are pointed as shown in FIG. 1 at 19 and 21 to facilitate the piercing of insulation. As best shown in FIG. 2, the bight and prong portions of the yoke are substantially flat in the form of a blade co-planar with an imaginary plane 22 extending in the direction of the overall length of the contact member. There is a horizontal offset arm 23 perpendicular to plane 22 and a downturned leg 24 extending parallel to plane 22 and in a direction opposite the blade. At the line 26, the cross-sectional thickness of the leg 24 is reduced and is low in the direction of arrows 37 (FIG. 2). Immediately below this, the metal of which the contact member is made turns to the rear (to the right as viewed in FIG. 2) at a right angle. It is curved from a point immediately adjacent the lower end 27 of the leg 24. Below the lower end of the curved portion the metal is turned horizontally back about a line 28 toward a plane 29 (FIG. 1) perpendicular to plane 22 and about which the upper end blade is symmetrical. The rolled lower end portion 12 extends downward therefrom and has the upper tubular or barrel portion 31 and lower pin portion 32 and bevelled seating shoulder 33.

This whole contact may be made of beryllium copper, primarily because of its superior spring characteristics for the insulation displacement blade end. Other materials might also be used. It is a unitary, homogeneous formed metal part, using state-of-the-art manufacturing technology. However, it has several important characteristics due to its above described construction. One of these is the particular ability of the pin end portion, which has a longitudinal axis 34, to resiliently move in three directions relative to the yoke end. This movement includes longitudinal movement in the direction 36 of the length of the member (parallel to the axis 34), lateral movement about the line 26 (FIGS. 1 and 2) in the direction of arrows 37 (FIG. 2) toward and away from the plane 22 of the blade portion, and lateral movement in directions perpendicular to the plane 29 of FIG. 1, as indicated by arrows 38 and accommodated by the relatively thin structure section thickness of the C-shaped curved portion 13A. As an example, the thickness of the leg at line 26 is approximately 0.010 inches. The cross-sectional thickness of the curved portion 13 measured at any location and in a direction parallel to plane 22 is the same as that for the leg portion at line 26, namely about 0.010 inches. In addition, the fact that the ends of the C-shaped curved portion are initially aligned with reference to the plane 29, permits increasing or decreasing the distance between these ends with or without offsetting of the contact end portions, as needed, to accommodate a difference in pitch between the conductors to be connected to the upper and lower ends of a plurality of these contacts in an assembly. Also, although the section thickness of this example is no greater than that of the portion 13A, the structural section thickness due to the formed barrel-shape is much greater in the direction of arrows 38. Thus, the lower end of the contact is rigid by comparison with the C-portion in the direction of arrows 38.

Figure 4:
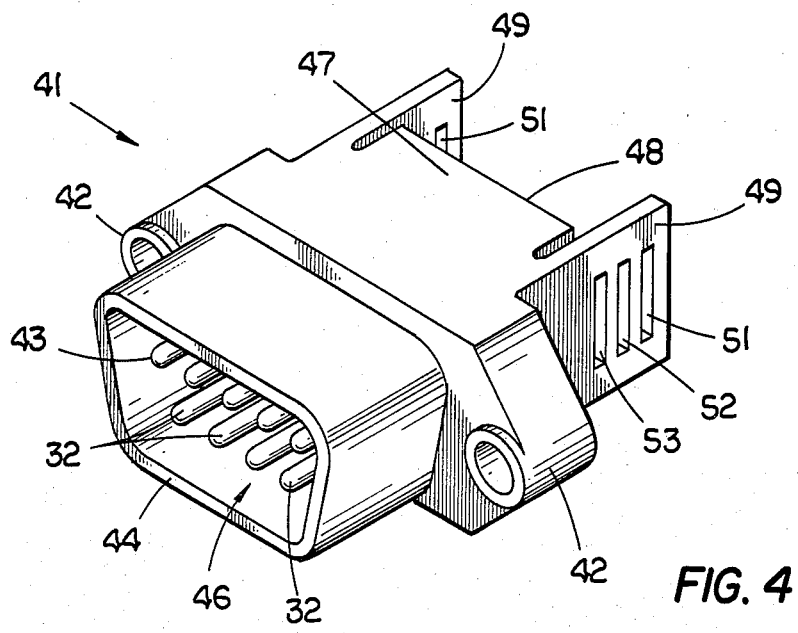
FIG. 4 is a perspective view of a D-type plug portion of a connector body according to one embodiment of our invention.

Referring now to FIG. 4, there is shown a D-type connector body 41 of the plug or pin-type with apertured flanges 42 for connection to a mating connector socket. Nine contact pins 32 are shown therein. The distal ends 43 of these pins are recessed slightly from the plane of the facing edge 44 of the pin cavity 46. This is better shown in FIGS. 7 and 11.

The body includes a contact carrier receiver boss 47 having an upper face (FIGS. 5, 7, 8 and 11) 48. It also includes a pair of integral end clips 49 spaced from and at opposite ends of the boss 47. These clips are integral portions of the body and each of them has three detent slots 51, 52 and 53 therein.

Figure 5:
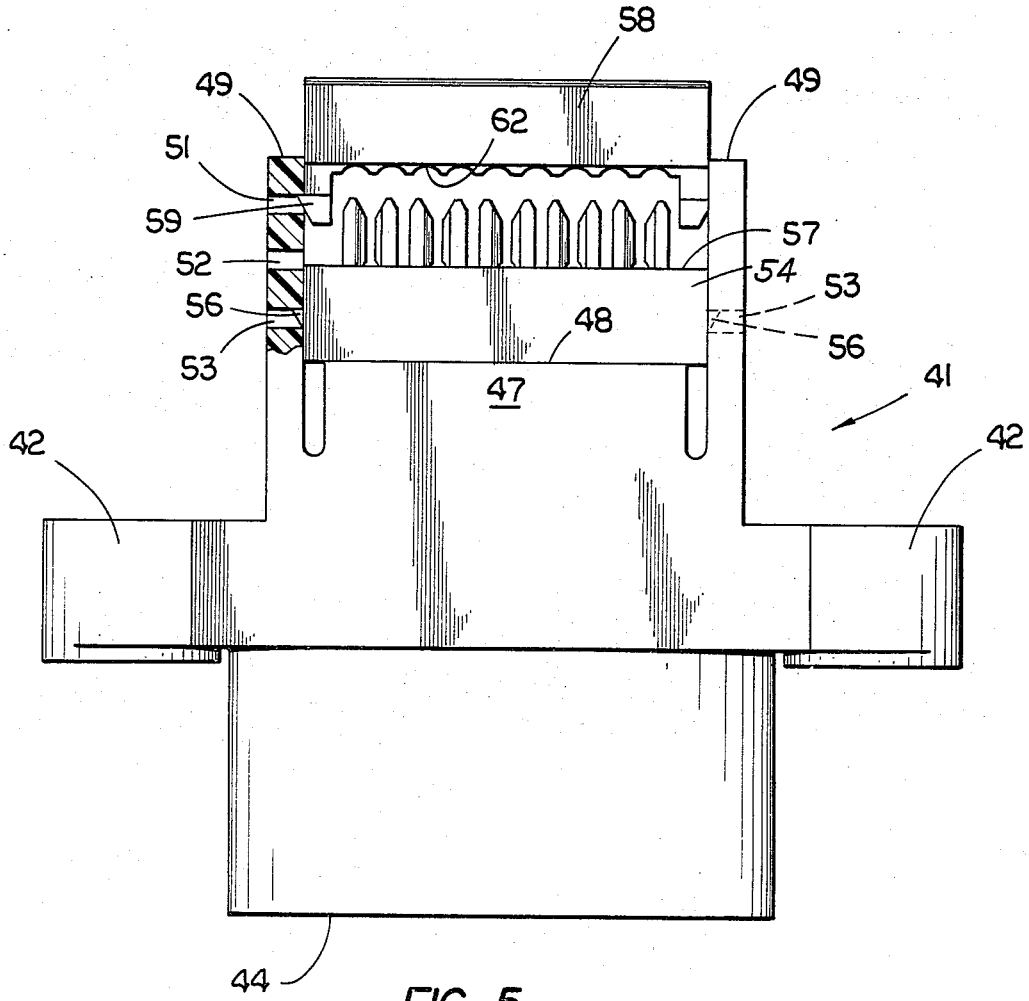
FIG. 5 is a front elevational view of the body of FIG. 4, in assembly together with a contact carrier and cap according to a typical embodiment of this invention, and prior to inserting the flat cable.

Referring now to FIG. 5, there is shown the connector body with the contact carrier insert 54 mounted therein atop the boss 47 at space 48. This insert is latched in position by a pair of elongated horizontally extending latching lugs 56, one of these lugs being at each end of the insert and received in the detent slot 53 in each of the end clips 49. Nine pairs of prongs such as 14 and 16 project upwardly from the upper face 57 of the insert. The clamp cap 58 is received between the end clips 49 and retained above the upper ends of the contact prongs by a pair of detent lugs 59 which are like lugs 56 but received in the detent slots 51 of the end clips 49.

Figure 6:
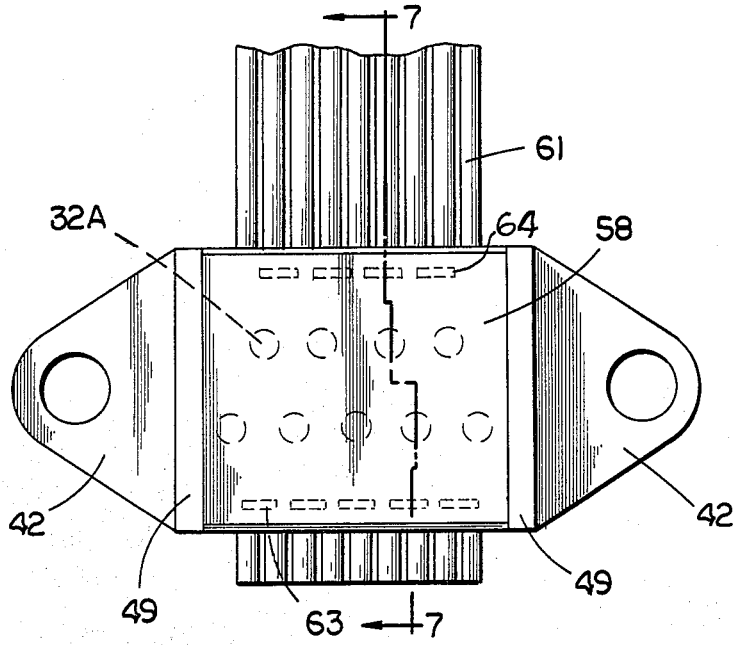
FIG. 6 is a top view thereof with the cable inserted and clamped in place.
Figure 7:
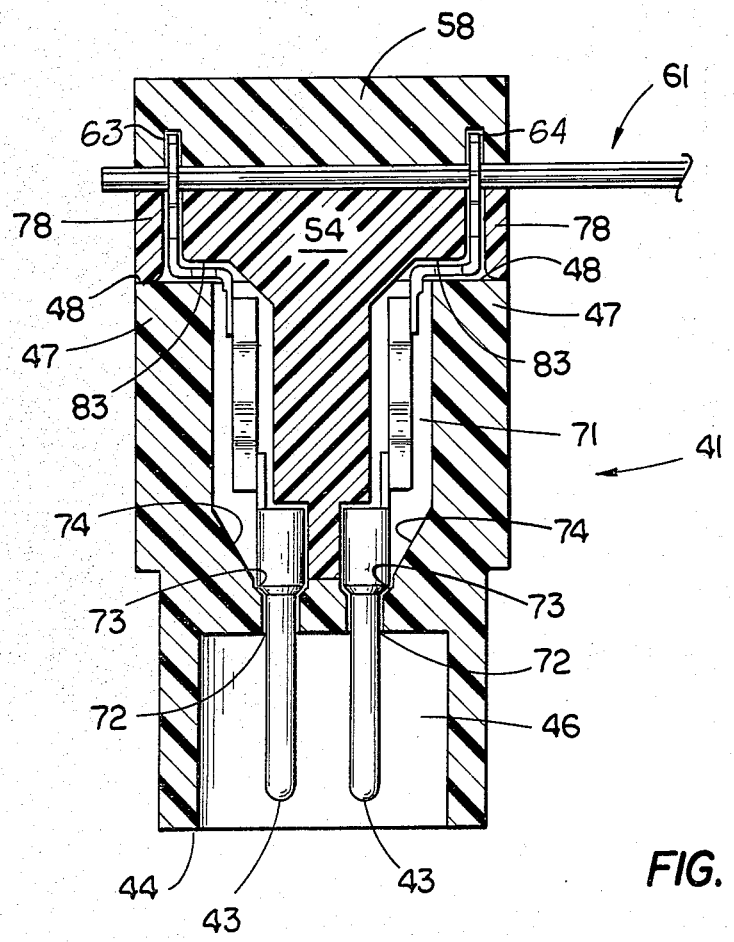
FIG. 7 is a section therethrough taken at line 7—7 in FIG. 6 and viewed in the direction of the arrows.
Figure 11:
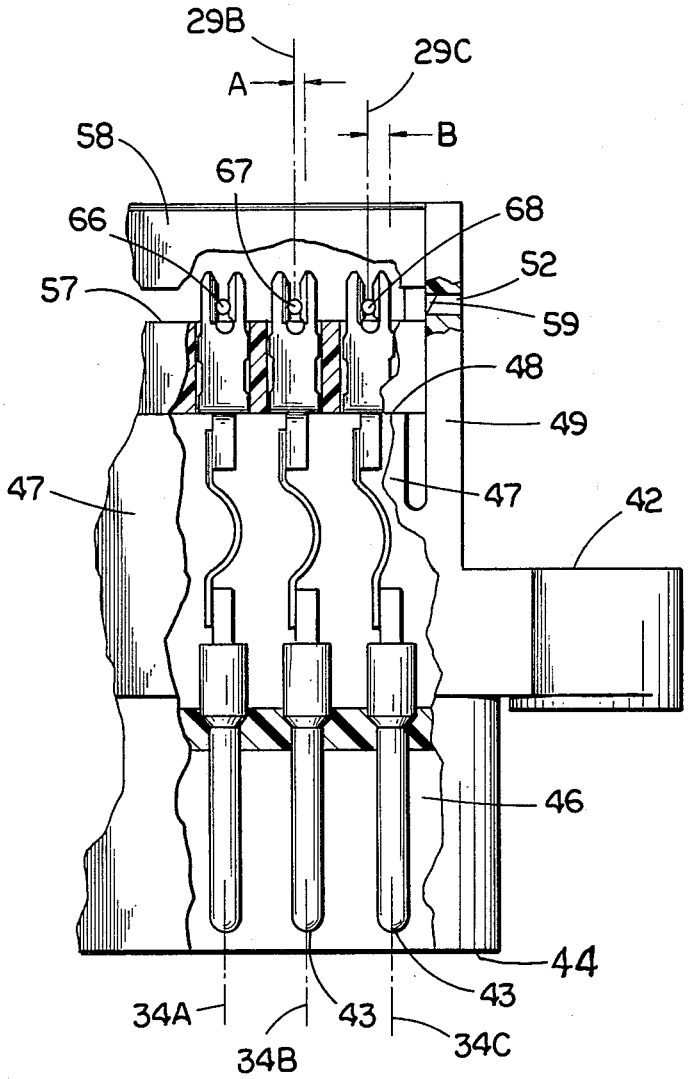
FIG. 11 is a front fragmentary view of the complete assembly with the flat cable installed, with a portion of the unit in section to show the transverse displacement between end portions of several of the contacts to accommodate the difference between the lesser pitch of the conductors in the flat cable and the greater pitch of the pins of the connector plug.

Referring now to FIGS. 6, 7 and 11, a flat cable 61 is clamped into position atop the contact carrier insert by the clamp cap 58. At this time, the cap latching lugs 59 are received and retained in the end clip slots 52. Each of the downwardly facing transverse grooves 62 in the cap receives one of the conductor covering ridges of the cable, while the bottom face of the cable is clamped snug to the upper face 57 of the contact carrier insert. The cap 58 has two rows of vertically extending slots 63 and 64 therein, these slots extending into the cap, thereby serving as apertures to receive the pointed upper ends of the contact prongs without interference with the prongs. The dotted circles 32A shown in the cap in FIG. 6 represent the locations of the nine contact pins in the pin cavity 46 at the opposite end of the connector assembly. Each different one of the apertures 63 and 64 in the cap is aligned wth a different one of the contact yokes and conductor cores or wires of the cable 61. Each different one of the cable cores is to be electrically connected to a different one of the nine pins. Observation of the relationship of the slots 63 in FIG. 6 to the pin locations shown therein by dotted lines reveals that no conductor core is precisely aligned with the pin to which it is to be connected except for the central one.

Referring now to FIG. 11, the center line 34A is the center line of the central pin of the front row of contacts. It is seen that this is in alignment with the center line of conductor 66 of the cable. The center line 34B is the center line of the pin immediately to the right of the center pin in the front row. It will be seen that this pin is offset with reference to a vertical plane 29B containing the center line of the conductor 67 of the flat cable. The offset is designated by the reference "A".

The center line 34C of the right-hand pin in the front row is offset with reference to a vertical plane 29C containing the center line of conductor 68 of cable 61. The amount of this offset is represented by the reference character "B". It is apparent that the amount of offset increases as the distance of the contact increases from the center line of the cable.

The above mentioned offset is accomodated while the axes of the pins remain parallel to the axes of the slots in the yokes of the contacts, by the curved portion of the contacts intermediate the upper and lower end portions thereof. In addition, it must be recognized that, as the amount of offset increases, the distance from the arm portion 23 of the upper end portion of the contact to the seating bevel 33 of the lower end portion of the contact must increase if the lower ends 43 of all of the pins are to remain at the same depth with respect to the plug end 44 while the yoke ends remain at the same location with reference to the boss 47 and conductor cable 61. The curved shape of the intermediate portion of the contact permits this to occur. It accomodates a greater or lesser spacing between the upper and lower ends of the contact, as needed, in order to obtain the correct directional orientation of the two ends of the contact and, at the same time, maintain their uniform height and depth with reference to the connector assembly.

It should be mentioned here that, while the curved shape in the contact intermediate portion as shown in the drawings herein does permit the increasing or decreasing of the distance between the opposite end portions of the contact, the specific C-shaped curve is not essential. Other shapes could be adopted for the intermediate portion and which, if extending indirectly from a point of junction with the relatively sturdy or rigid end portion at each end of the connector, may achieve the same result. By indirectly, it is meant that the connecting member does not extend in a straight line so as to provide an essentially inextensible link between the two end portions. A rectilinear member would not suffice, whereas a curvilinear or angular member might be used.

Referring further to FIG. 7, it can be seen that the contact carrier insert 54 is generally T-shaped. It is received in a carrier and contact cavity 71 of the connector body. This cavity has nine apertures 72 at the lower end thereof opening into the cavity 46. A bevelled seating surface 73 is provided at the upper end of each of these apertures and communicates with the sloping wall 74 at the front and rear of the carrier and contact cavity 71.

Figure 10:
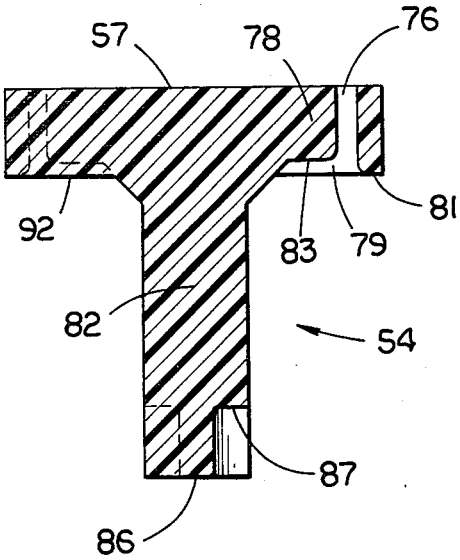
FIG. 10 is a section through the contact carrier insert taken at line 10—10 in FIG. 9 and viewed in the direction of the arrows.
Figure 9:
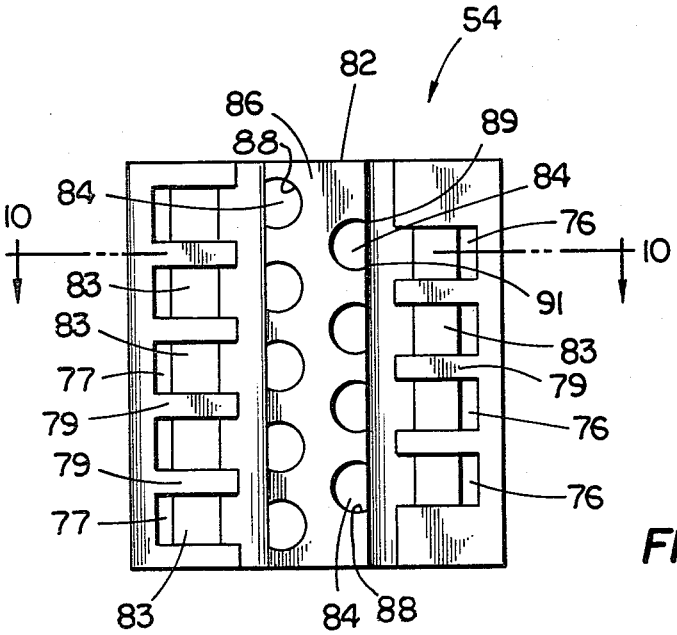
FIG. 9 is a bottom view of the contact carrier insert.

The carrier insert itself is shown in more detail in FIGS. 9 and 10. While the top 57 of the insert is flat and includes a plurality of apertures 76 and 77 similar to and aligned with the apertures 63 and 64 of the cap, the bottom of the head portion 78 of the insert is provided with a plurality of separator webs 79 between the skirt portion 81 of the head and the stem 82 of the insert. In this way there is provided a separate receiver pad 83 for the arm 23 of each contact. Therefore, as an example, the blade of a contact can be pushed up through aperture 76 and the upper travel will thereupon stop when the upper face of arm 23 engages the pad 83 under the head of the insert.

Figure 8:
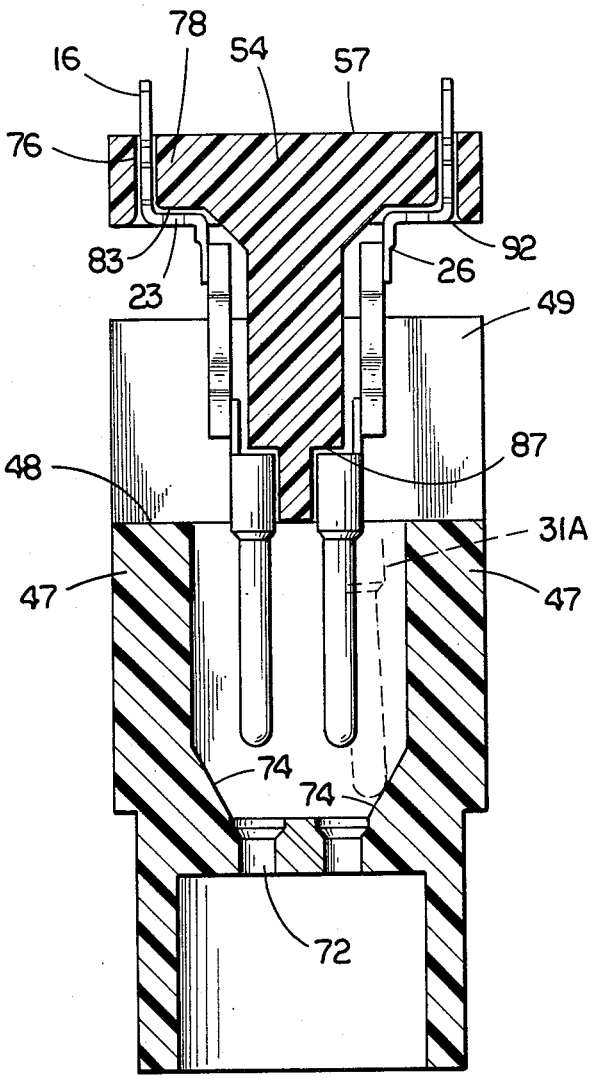
FIG. 8 is a section similar to FIG. 7, but showing the base and carrier insert prior to complete assembly.

At the lower end of the insert stem 82, there are nine part-circular grooves 84 projecting up from the lower face 86 and terminating at 87, for example. As best shown in FIG. 9, these grooves provide more than 180° of wall surface 88 so that the entrance to the groove in the horizontal direction is between edges 89 and 91 which are at a lesser dimension than the diameter of the upper barrel 31 of each of the contact pins. The diameter of each of these grooves or pockets 84 is slightly greater than the outside diameter of the barrel 31 of the pin. The location of the upper end 87 of each of these pockets, with reference to the seating lower face 92 of the insert head, is slightly less than the normal vertical or longitudinal distance between the lower face 23L of the contact and the upper end 31U of the contact pin. Therefore, when a contact is pushed up into the head, and the upper face of the arm 23 seats against a pad 83, the upper end 31U of the pin is slightly below the upper end of the socket 84. Since the diameter of the pin barrel 31 is greater than the socket entrance width between edges 89 and 91, the pin may normally be located as shown by the dotted line 31A in FIG. 8. However, it can be pushed into the socket to establish the solid line position such as shown for the two pins in FIG. 8. This is possible because the material of the insert, as is true of the connector body and clamping cap, is a resilient dielectric material such as polyester thermoplastic. Of course, this resilient feature enables the snapping of the insert into the body from the position shown in FIG. 8 to that found in FIG. 7, and also the snapping of the cap 58 into the preliminary position of FIG. 5 and the clamping position of FIGS. 6, 7 and 11. The ability of the pin to be in the misaligned condition relative to the yoke blade as shown by the dotted line in FIG. 8 is provided by the relatively thin section thickness at line 26 as described above with reference to FIG. 2. By noting the locations of the pockets 84 with respect to the pads 83 in FIG. 9, it can be seen that the offsetting of the yoke end portion of the contact with respect to the pin end portion is increasingly drastic as one advances from the longitudinal center of the insert toward the opposite ends. Nevertheless, as described above with reference, particularly to FIG. 11, the intermediate portion of the contact accommodates this difference in spread.

With further reference to FIGS. 7 and 8, it should be noted that when the carrier insert 54 is pushed into place in the body, the upper ends 87 of each of the pin barrel pockets will serve to drive the pins down through the apertures 72 in the connector body until the seating bevel 33 of each pin engages the bevelled seat 73 of the body of each of the nine apertures 72 therein. Accordingly, the pins have a uniform degree of projection into the cavity 46. The latching of the carrier occurs at that time by the engagement of the latching lugs 56 with the detent slots 53 in the end clips 49. Although the end clips are sufficiently resilient to spread enough to accomodate the latching lugs as the lugs are inserted, due to the bevelled lower or leading edge of the lugs, the straight upper edges of the lugs abuttingly engage the lower edges of the slots to prevent movement of the insert away from the contact seating position. Since it could be possible to over drive the pins into their seats, the lower face 92 of the head of the insert abuttingly engaging the upper face 48 of the carrier receiving boss 47 of the body, prevents this from happening. At the same time, there is sufficient space between face 48 and the pads 83 to provide a small amount clearance between the arms 23 and the face 48 and pads 83. The arms will normally be seated on the face 48 as a minor amount of tension is applied from the seated pin bases through the intermediate portions of the contacts to the lower faces of the arms when they engage the face 48 so that each of the contacts is in a very slight resiliently snug position in the body 41.

The cooperation of the shoulders or webs 79 with the side edges of the arms 23 assist in maintaining the correct attitude of the prongs in the insert head despite the lateral offsetting of the pin barrels for reception in the sockets in the stem of the insert. Accordingly, they help keep the contacts from contacting each other during manufacture. The pre-assembly of the pin barrels into the sockets assists the ready piloting of the pins into the apertures in the body. Further assistance is provided by the cavity slope walls 74 and bevelled pin seats 73.

Figure 12:
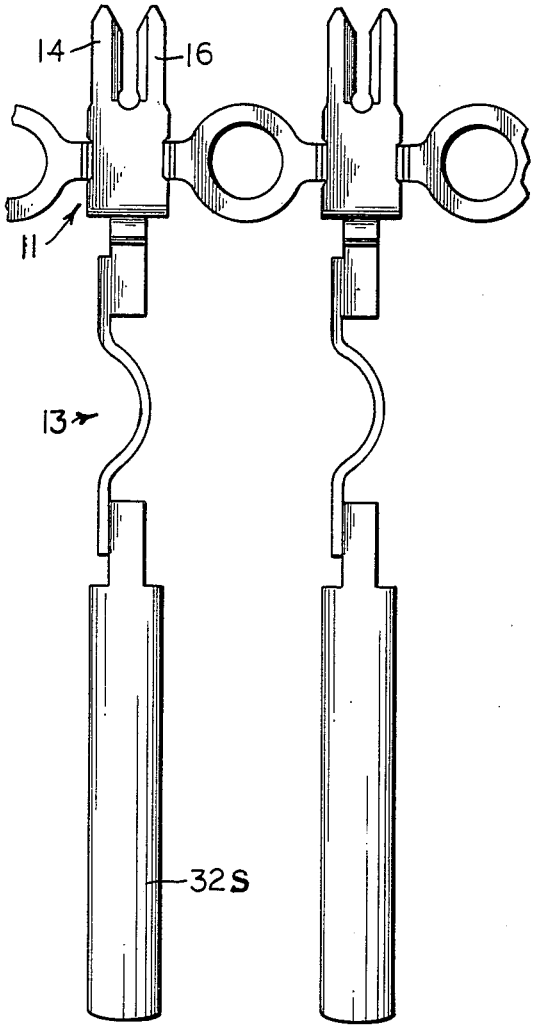
FIG. 12 is a front view of a contact similar to that of FIG. 1, but wherein a tubular socket rather than pin is provided at the end opposite the insulation displacement end, and two such contacts are shown on a manufacturing carrier strip.
Figure 13:
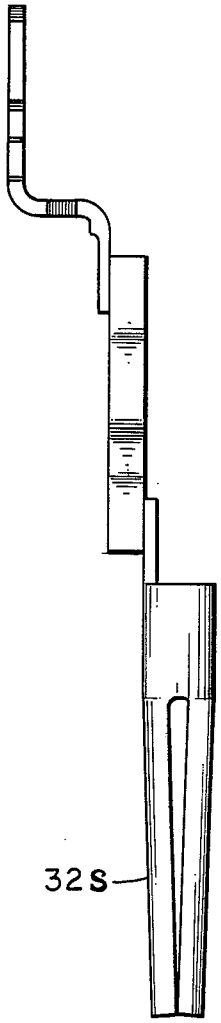
FIG. 13 is a side view of the embodiment of FIG. 12, but omitting the carrier strip.
Figure 14:
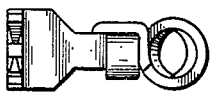
FIG. 14 is a top view of the embodiment of FIG. 12, but omitting the carrier strip.

From the foregoing, it can be seen that the present invention provides a versatile, readily made connector in which the connector body provides the dimensional control so far as the height of the terminals are concerned. The illustrations in FIGS. 12, 13 and 14 show a contact which, instead of having a pin at the lower end, has a slotted pin receiver socket 32S. The socket axis is essentially the same as the pin axis previously described, and the three dimensional freedom of movement of the socket with respect to the insulation displacement yoke is the same. Accordingly, this particular contact can be used for the insulation displacement connection of a flat cable to a D-type connector socket. It should also be recognized that the lower end portion can be of a variety of other configurations, depending upon the type of connector assembly in which the pitch adaptation is to be achieved. Pitch adaptation may be of either an increasing (as described above) or decreasing pitch between the two contact ends. An example of the decreasing pitch would be for telecommunication connectors for adaptation between a flat cable as discussed above, and a conductive ribbon having a still lower pitch than the cable. Also, the lower end portions could be adapted for wire wrapping or solder pot connections, for example. In addition, the technique of the present invention could also be applied where the upper end is not an insulation piercing and displacement type of connector. Therefore, the versatility of the present invention can be readily recognized.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An electrical contact comprising:

an elongate member of electrically conductive material having a first end portion for engaging a first electrical conductor, a second end portion for engaging a second electrical conductor, and an intermediate portion joined to said end portions, said intermediate portion shaped to elastically sustain the weight of each of said end portions when the member is gripped at the other of said end portions, regardless of orientation of said other end portion, but accommodate intentional variation of the distance between said end portions, said first end portion including an insulation piercing and displacing yoke formed to define a wire receiver slot oriented to receive a wire with its axis perpendicular to said first plane, part of said intermediate portion having a substantial cross sectional thickness, measured in a first direction perpendicular to said plane, and said part of said intermediate portion having a lesser cross sectional thickness, measured perpendicular to said direction, to accommodate resilient bending of said intermediate portion in a plane parallel to said first plane for changing the distance between the junctions of said intermediate portion to said end portions;

said yoke being formed by a pair of substantially flat and coplanar prongs lying in said first plane, and a bight from which said prongs project;

and an offset arm extending from said bight perpendicular to said first plane;

a leg extending from said arm in a direction opposite the direction of projection of said prongs, and in a second plane parallel to said first plane, said leg having a portion remote from said arm rearwardly turned and commencing said part of said intermediate portion, said leg having a reduced cross section thickness measured in a direction perpendicular to said planes at a line between said rearwardly turned portion and said arm, said part of said intermediate portion turning parallel to said second plane at a point remote from said line and extending to said second end portion.

2. An electrical connector assembly comprising:

a body having a "D" shaped contact housing for mating with a "D" shaped contact housing in another connector assembly;

a plurality of electrical contact members in said body, each member having first and second end portions adapted to make electrical connections with electrical conductors, the first end portions of said contact members having uniform extent of exposure to conductors outside said body, and the second end portions of said contact members having uniform extent of exposure to conductors outside said body, the pitch of said first end portions being different from the pitch of said second end portions;

said first end portions being insulation piercing and displacement yokes, said second end portions being elongate and of generally round cross section, said contact housing facing in one direction, and said body having a cavity opening in the opposite direction, the assembly further comprising:

a contact carrier unit received on said body and projecting into said cavity, said carrier unit having a plurality of pockets along one face and receiving parts of said second end portions of said contact members, and said carrier unit having a plurality of apertures in another face which faces in said one direction, with said first end portions extending in said one direction from said cavity, through said apertures beyond said another face;

said apertures being equally spaced in one row and said pockets are equally spaced in another row, the center-to-center spacing of the apertures equalling the pitch of said first end portions, and the spacing of the pockets equalling the pitch of said second end portions, each aperture having a corresponding pocket, and the apertures and corresponding pockets being offset from each other in the direction of said rows and in greater amounts at greater distances from a plane perpendicular to the said direction of said rows;

said carrier having a head and stem, with said apertures being in said head, and said pockets being in said stem, the parts of said contact end portions received in said pockets being cylindrical, each of said pockets having a wall interrupted at the side of said stem to provide an entrance slot having a width less than the diameter of said cylindrical part, and the slot having resilient edges at the side of said stem to enable the cylindrical part to be laterally snapped into said slot and retained therein;

said head having a plurality of barrier walls transverse to said apertures and located between the end of each aperture and the end of the next adjacent aperture, each of said contact members having an intermediate portion between said first and second end portions, said intermediate portion being shaped to accommodate movement of said first end portion of a contact member relative to the second end portion of a contact member in three directions perpendicular to each other, the first end portion of each contact member having a transverse arm fittingly located between a pair of said barrier walls to inhibit movement of said arms toward each other.

3. An electrical connector assembly comprising:

a body having a "D" shaped contact housing for mating with a "D" shaped contact housing in another connector assembly;

a plurality of electrical contact members in said body, each member having first and second end portions adapted to make electrical connections with electrical conductors, the first end portions of said contact members having uniform extent of exposure to conductors outside said body, and the second end portions of said contact members having uniform extent of exposure to conductors outside said body, the pitch of said first end portions being different from the pitch of said second end portions;

said first end portions being insulation piercing and displacement yokes, said second end portions being elongate and of generally round cross section, said contact housing facing in one direction, and said body having a cavity opening in the opposite direction, the assembly further comprising:

a contact carrier unit received on said body and projecting into said cavity, said carrier unit having a plurality of pockets along one face and receiving parts of said second end portions of said contact members, and said carrier unit having a plurality of apertures in another face which faces in said one direction, with said first end portions extending in said one direction from said cavity, through said apertures beyond said another face;

said apertures being equally spaced in one row and said pockets being equally spaced in another row, the center-to-center spacing of the apertures equalling the pitch of said first end portions, and the spacing of the pockets equalling the pitch of said second end portions, each aperture having a corresponding pocket, and the apertures and corresponding pockets being offset from each other in the direction of said rows and in greater amounts at greater distances from a plane perpendicular to the said direction of said rows;

said carrier having a head and stem, with said apertures being in said head, and said pockets being in said stem, the parts of said contact end portions received in said pockets being cylindrical, each of said pockets having a wall interrupted at the side of said stem to provide an entrance slot having a width less than the diameter of said cylindrical part, and the slot having resilient edges at the side of said stem to enable the cylindrical part to be laterally snapped into said slot and retained therein;

said stem projecting into said cavity;

said body having a plurality of apertures in a row and communicating between said cavity and said contact housing and aligned with said pockets;

said body having contact seats between said cavity and said apertures; and said contacts having seating surfaces between said cylindrical parts and the distal ends of their said second end portions, said seating surfaces being abuttingly engaged with said sheets and thereby limiting the amount of projection of said second end portions into said contact housing;

said carrier having another head opposite the first mentioned head, whereby said carrier is T-shaped in cross section, with the heads of the T resting on a carrier receiver boss of said body, said cavity being in said boss, and said stem being in said cavity, with a second row of contact receiving apertures in said head parallel to said first row, and a second row of pockets in said stem on the side opposite the first mentioned side of said stem; and a second row of apertures in said body beside said first row, and a second set of contact members like the first mentioned contact members and received in the second rows of apertures and pockets and at locations staggered lengthwise of the rows with respect to the first mentioned contact members;

said seats being bevelled, said cavity having side walls sloped toward said apertures in said body, to lead said contact second end portions into said apertures during assembly of said carrier to said body.

* * * * *